US010017902B2

(12) United States Patent
Moorhead

(10) Patent No.: US 10,017,902 B2
(45) Date of Patent: Jul. 10, 2018

(54) TIE GANG BALLAST REPLACER-COMPACTOR AND RELATED METHODS

(71) Applicant: William Moorhead, Smithfield, VA (US)

(72) Inventor: William Moorhead, Smithfield, VA (US)

( * ) Notice: Subject to any disclaimer, the term of this patent is extended or adjusted under 35 U.S.C. 154(b) by 24 days.

(21) Appl. No.: 15/161,161

(22) Filed: May 20, 2016

(65) Prior Publication Data

US 2016/0340836 A1 Nov. 24, 2016

Related U.S. Application Data

(60) Provisional application No. 62/165,246, filed on May 22, 2015.

(51) Int. Cl.
*E01B 27/20* (2006.01)

(52) U.S. Cl.
CPC ..... *E01B 27/20* (2013.01)

(58) Field of Classification Search
CPC ..... E01B 27/20
USPC ..... 104/2–12
See application file for complete search history.

(56) References Cited

U.S. PATENT DOCUMENTS 3,000,328 A 9/1961 Plasser et al.
3,608,496 A 9/1971 Schenkir et al.
3,621,785 A * 11/1971 Fearon et al. ..... E01B 27/021 104/12
3,797,397 A 3/1974 Eisenmann et al.
4,063,517 A * 12/1977 Nardozzi, Jr. ..... A63G 3/00 104/134
4,489,658 A * 12/1984 von Beckmann ..... E01B 27/20 104/12
5,511,485 A * 4/1996 Romani ..... E01B 27/02 104/2
2006/0159526 A1* 7/2006 Bonasso ..... E01C 3/003 405/284
2016/0340836 A1* 11/2016 Moorhead ..... E01B 27/20

FOREIGN PATENT DOCUMENTS

WO 2006042461 A1 4/2006
WO 2011084793 A1 7/2011

OTHER PUBLICATIONS

International Search Report and Written Opinion for PCT/US13/25540 (dated Apr. 12, 2013).

* cited by examiner

*Primary Examiner* — Jason C Smith
(74) *Attorney, Agent, or Firm* — McClure, Qualey & Rodack, LLP

(57) ABSTRACT

Ballast replacer-compactors and related methods are provided. A representative ballast replacer-compactor includes: a frame; a crib compactor mounted to the frame and operative to compact crib ballast; and a compactor bar mounted to the frame and operative to urge crib ballast downwardly and beneath a tie. A representative method for servicing rail system ties includes: engaging crib ballast positioned adjacent to a target tie; and forcing the crib ballast downwardly and beneath the target tie.

8 Claims, 14 Drawing Sheets

TIE GANG BALLAST REPLACER-COMPACTOR AND RELATED METHODS

CROSS REFERENCE TO RELATED APPLICATION

This utility patent application claims the benefit of and priority to U.S. Provisional Application 62/165,246, filed on May 22, 2015, the entirety of which is incorporated herein by reference.

DESCRIPTION OF THE RELATED ART

Pressure-squeeze type tampers are typically used in tie gangs during maintenance, such as when ties of a rail system are being replaced. However, as these tampers use opposed, vibrating tamping bars, new ballast is not placed under the ties. Rather, these devices simply squeeze the existing foul ballast under the ties, often without any real compaction, depending on how fast and how many insertions the operator uses. This may result in new ties often not being in bearing through several surfacing cycles, essentially transferring the load to the remaining, possibly weaker ties, negating much of the benefits of the spot tie renewal and resulting in weak and rough riding track.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
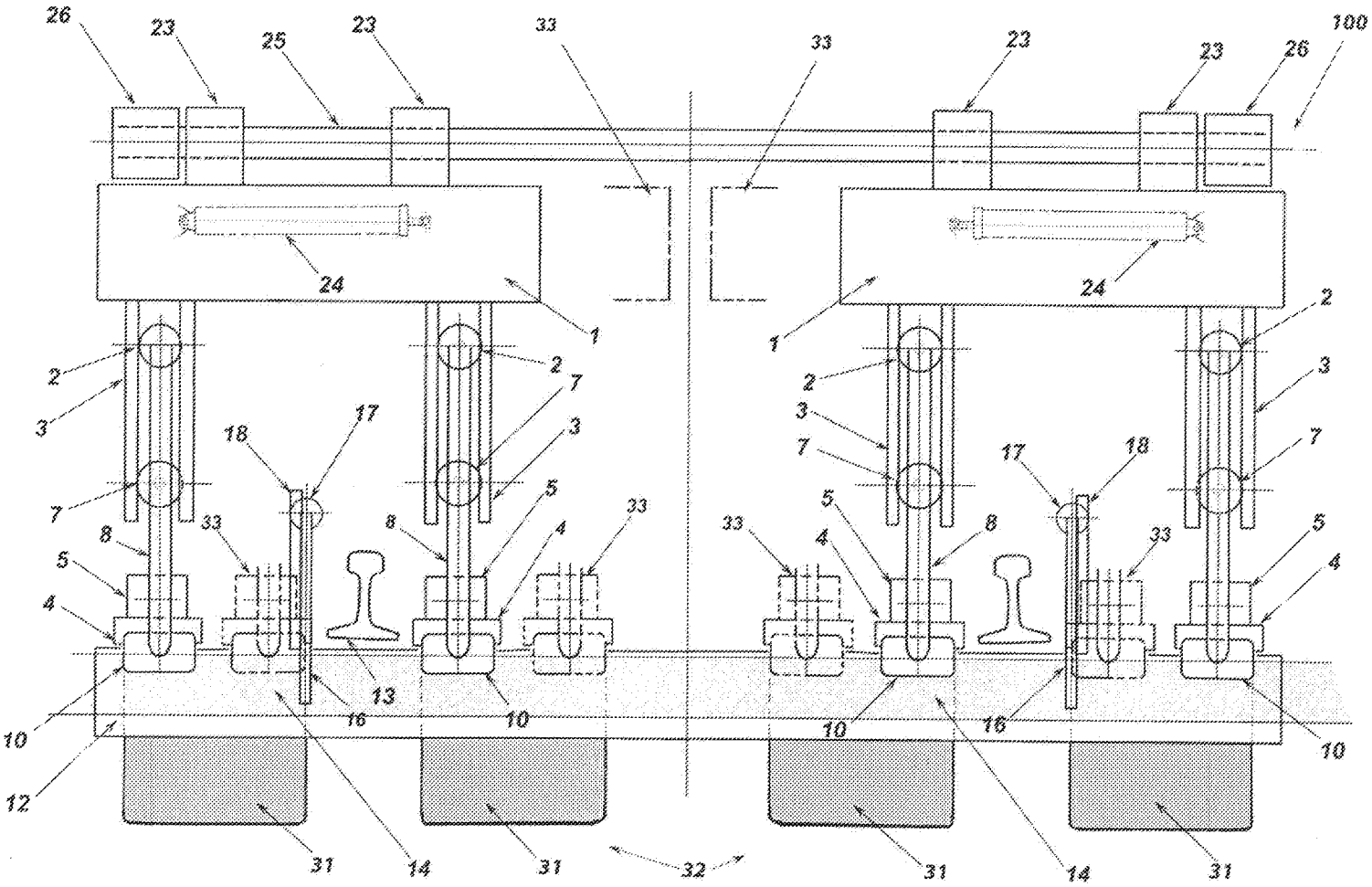
FIG. 1 is a schematic, front view of an example embodiment of a tie gang ballast replacer/compactor.

Reference will now be made in detail to the description of the disclosure as illustrated in the drawings. While the disclosure will be described in connection with these drawings, there is no intent to limit it to the embodiment or embodiments disclosed herein.

In this regard, various embodiments of a Ballast Replacer-Compactor may remedy one or more of several problems associated with the current use of pressure-squeeze type tampers in tie renewal gangs. In particular, in some embodiments, a Ballast Replacer-Compactor (BRC) may work on a different principle, altogether. A BRC (100) (such as the embodiment depicted in FIGS. 1-6, for example) may replace a large portion of the ballast bed under the target tie by first engaging the crib ballast with the compactor bars, which are facing downward. Often this crib stone is the freshly dumped, clean ballast required for a raise that ideally will go under the ties. Even when not freshly dumped, the crib ballast is invariably in better condition than the ballast under the ties, as it has not been broken and abraded by train action and is essentially undamaged. The compactor bars, following a downward arcuate path, push this clean stone down through the crib and under the ties, displacing the foul ballast, which flows up into the crib behind the target tie. That crib was partially evacuated by the compaction of the previous tie. The compactor bars first pass nearly completely under the target tie; on further insertions, the path is shortened as the ballast pushed under the tie becomes consolidated. Pressure sensing circuits control this variation in the compaction strokes. This novel and effective method assures that 1) a large volume of clean ballast is placed under the ties; and, 2) that the ballast is properly and fully compacted so the new ties are in full, effective bearing Immediately.

The BRC has a crib compactor plate mounted behind the target tie; this vibrating plate is deployed and compacts the crib ballast behind the target tie as the compactor bars on the front side are withdrawn. This assures that the cribs are tight and providing the required lateral and longitudinal resistance needed in freshly disturbed track to have adequate stability, especially in hot weather to avoid sun kinks.

As the crib compactor and compactor bars, on opposite sides of the target tie, do not engage the ballast at the same time, the ballast is not trapped between two high-pressure, vibrating, squeezing faces that tend to break and destroy the ballast—as the current pressure-squeeze tampers often do.

In some embodiments, a variable rate of oscillation (OPM) frequency for the compactor bars and the crib compactor may be used, as higher frequencies aid insertion into the ballast but lower frequencies are more effective during the compaction portion of the cycle. The BRC may be fitted with variable-rate oscillation vibrator motors and can change the higher frequency OPM during the stroke to push the crib ballast down through the surrounding ballast and then reduce the OPM's for better compaction. The compactor pressure may be variable and can be set by the operator for optimum compaction of the ballast under the target tie without humping the track.

The result of these innovations is a Ballast Replacer-Compactor that may, in some embodiments, provide the proper consolidation and support under spot-renewed cross-ties after the first pass, resulting in reliable, more uniform ballast support and higher quality, safer track. This technique can be scaled and speeded up to provide the same valuable benefits to production surfacing/tamping equipment, resulting in longer intervals between surfacing cycles and less geometry degradation and rough track in all tracks, including heavy-tonnage areas of operation.

An example embodiment is depicted in the illustrations of FIGS. 1-6 and includes the following representative components:

Reaction mass (1)—two are provided, with each mass weighing approx. 2,000-2,400 lbs. per Replacer/Compactor Work Head. The reaction mass (1) provides the downward reaction force required to push the crib ballast (14) down and compact it without having to anchor to the rails (13) or humping the track. The mass (1) and attached components of Replacer/Compactor Work Head can be raised and lowered and also traversed like a switch tamper to provide full compaction coverage of bearing area (see plan view FIG. 4 and other views). The mass (1) is fitted with a laterally movable frame (23) that is positioned by a hydraulic cylinder (24) to slide laterally on guide bars (25), which in turn are mounted into weld frame (26). Weld frame (26) is movable vertically on guide rods (27) mounted to chassis (22), with the power being provided by hydraulic cylinders (28).

Hydraulic cylinder (2)—four are used, one per tamping bar. The hydraulic cylinders provide closing action to compactor bars. Hydraulic cylinder (2) is controlled by sequence and pressure sensors to provide the arcuate (e.g., elliptical) path of compactor bars and proper compaction forces. The range of forces varies by ballast type and condition, and can be field adjusted.

Compaction head frame (3)—two are attached to each mass (1). Frame (3) provides mountings and pivots for working components of the compaction head.

Crib compactor (4)—comprised of four sections, two each in the gage of track and one each on field side of both rails (13). Each section is fitted with a free-body vibrator (5) that compacts the crib ballast (14) after the tie bed ballast has been compacted. Each section is supported and deployed by linkage (6) and lifting cylinders (7). In some embodiments, commercial concrete vibrators may be used to provide oscillation at the correct, variable OPM for the ballast type being worked.

Compactor bars (8)—two per compaction head, with one on the gage side, one on the field side of each rail. Compactor bars (8) are driven by eccentric drives (9) and closure activated by cylinders (2). Compactor bars (8) have replaceable pusher faces (10) that are shaped to clear ties during arc of travel and are easily replaceable for wear. The pusher faces are supplied in different shapes to suit the type of ballast (e.g., large gradation, sharp stone vs. gravel, for instance).

Oscillation eccentric drive (9)—each compactor bar (8) pivots from an eccentric drive, which is driven by a variable-speed hydraulic motor (not shown). In this embodiment, each eccentric drive provides up to ¼" throw at OPM variable from 1,000 to 3,600 OPM (optimum OPM for pushing and compacting actions are programmed into the control system depending on ballast type).

Pusher faces (10) are in position where replacer/compaction cycle begins when operator lowers Replacer/Compaction work head to "start" Position 3. Tie lock jaws also engage ties at this position.

Figure 4:
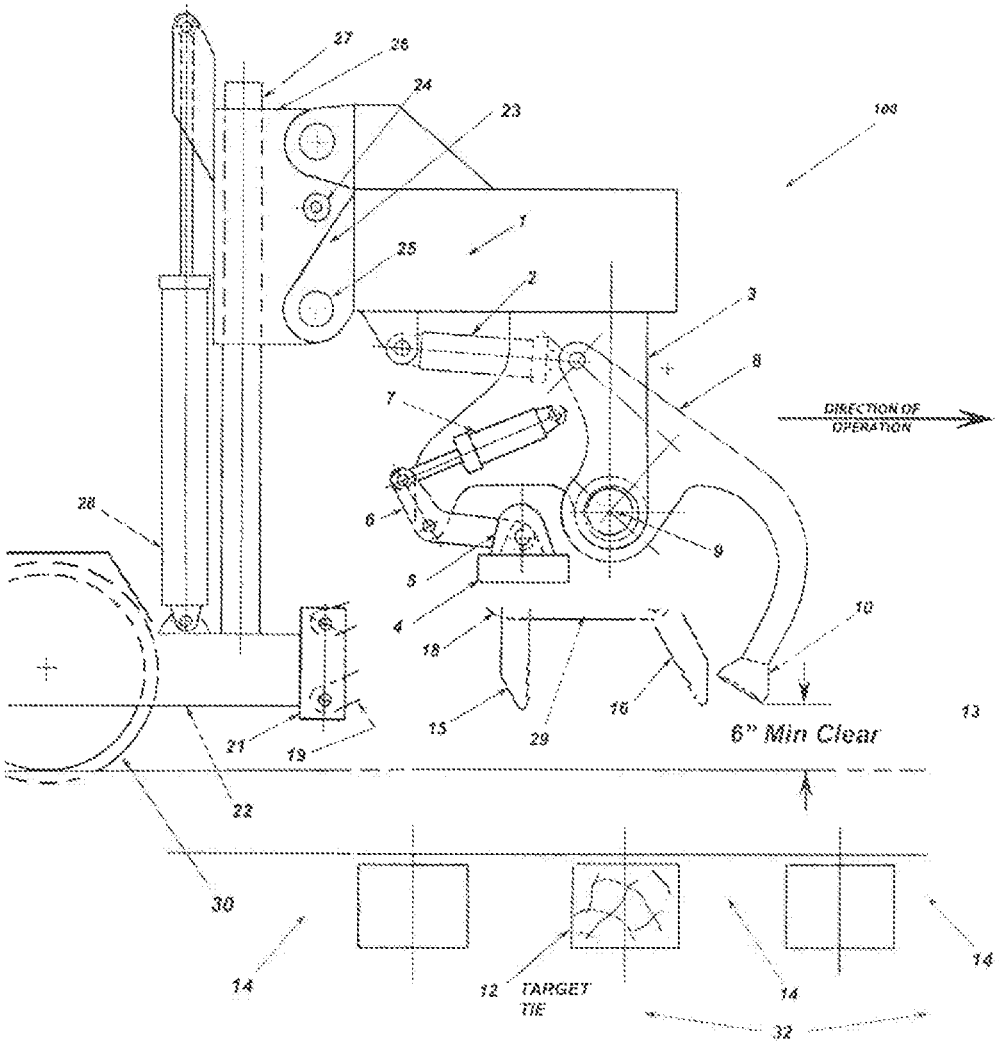

Shaded area (11) shows "swept" area covered by the pusher faces (10) as they pass through their paths from insertion into the crib. In some embodiments, width is 7" +/−1", maximum width that is compatible with efficient ballast moving and compacting. In FIG. 4 (plan view), shaded areas (31) show the lateral path the compactor bars follow as the width of the bearing portion of the tie beds is progressively tamped, requiring a minimum of three compactor bar insertions to cover the whole area to be tamped.

Figure 3:
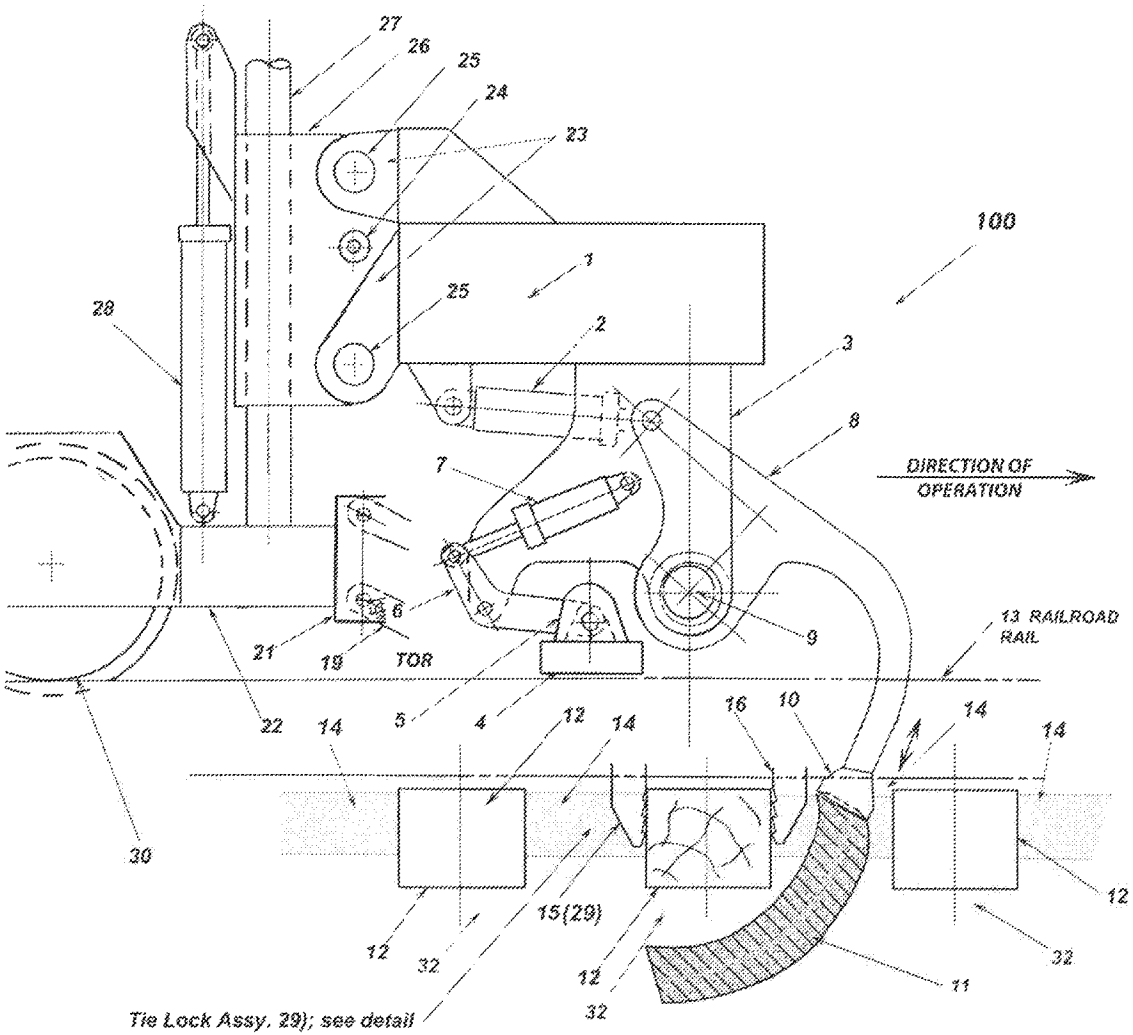
FIGS. 3-6 are schematic, side views of the embodiment of FIG. 1.

Patterned areas (14) in FIGS. 1 and 3 show the crib ballast, which is the ideal material to be placed under the ties, as the crib ballast is invariably cleaner and less damaged than the ballast directly under the ties, and is therefore more desirable as a tamping material. Crib ballast (14) varies in thickness, but is usually at least 5" thick.

Crossties (12)—7"×9", conventional wood ties at 18" OC shown. Other tie types and configurations may be used. Concrete ties are spaced differently but are handled similarly. It should be noted that an adjustment of the compaction arc may be required to provide clearance for oversized ties.

Chassis (22)—includes flanged wheels (30) fitted to axles, which support a frame fitted with various components, such as an engine, hydraulic and pneumatic pumps and compressor, and an electrical system, and having an operator control station, propulsion system, brakes, etc.

Tie locks (29)—two sets are used, mounted on the field side of rails (13). The tie locks (29) engage ties (12) to prevent sliding induced by asymmetric pressure such as that exerted by the compactor bars on only one side of the ties, and also the crib compactor forces on the ballast in the trailing crib. The ties are clamped by two fixed jaws (15) and two movable jaws (16), activated by two hydraulic cylinders (17). These components are mounted on two welded steel frames (18), which in turn are supported by four pivotally mounted arms (19) actuated vertically by two hydraulic cylinders (20) and are attached to a bracket (21) on the front of the chassis (22).

Shaded area (31) shows the width across the track that the pusher faces (10) and crib compactors (4) and (5) can reach and compact effectively.

Fouled ballast (32) is the ballast section underlying the crossties (12) that is often badly fouled.

Phantom outlines (33) showing mass (1), pusher faces (10), and crib compactor (4) at their innermost position and also shows the width across the track that can be tamped effectively.

Figure 2:
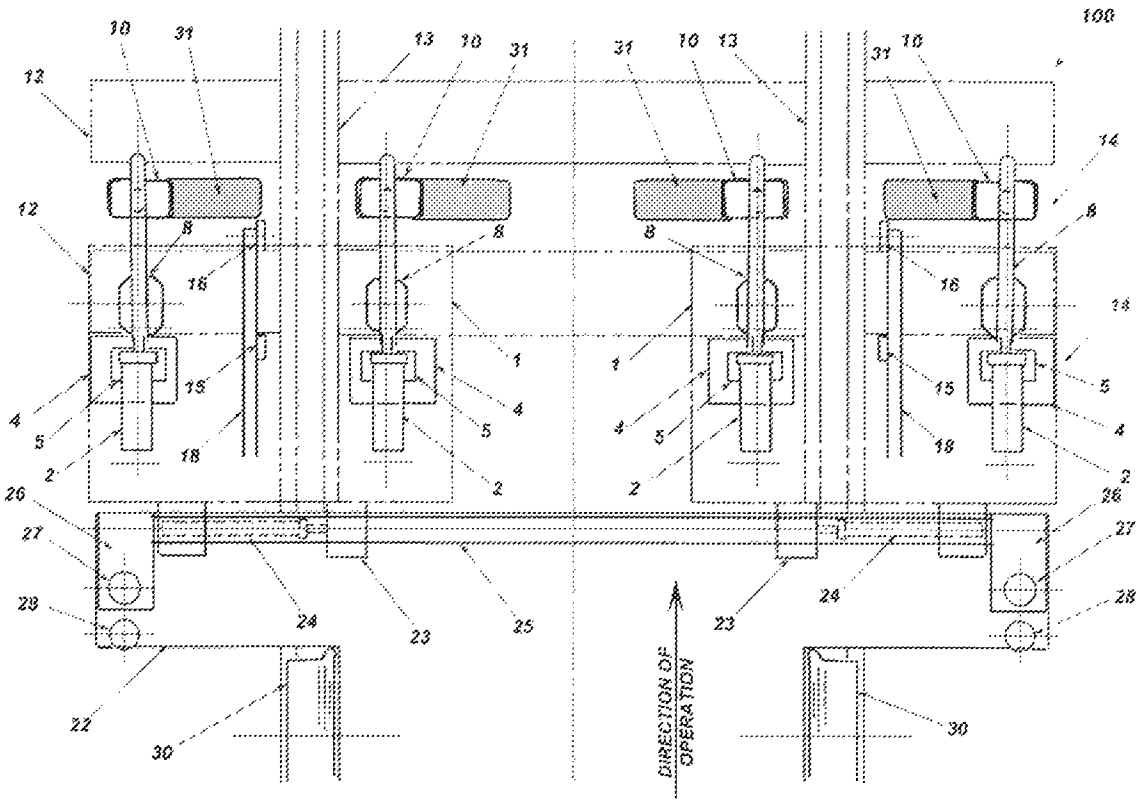
FIG. 2 is a schematic, plan view of the embodiment of FIG. 1.

The aforementioned components are shown in the deployed condition with the track-engaging tool elements engaging the ballast and ties in the work position in FIGS. 1, 2 and 3. The components are shown in FIG. 4 in the "clearing" or travel position, in which the components are up out of the track in position to allow safe, speedy travel over the track. In some embodiments, all of the tool elements that can drop down and foul the track are fitted with safety pins and locks to prevent inadvertent contact with the track during the travel mode.

Figure 5:
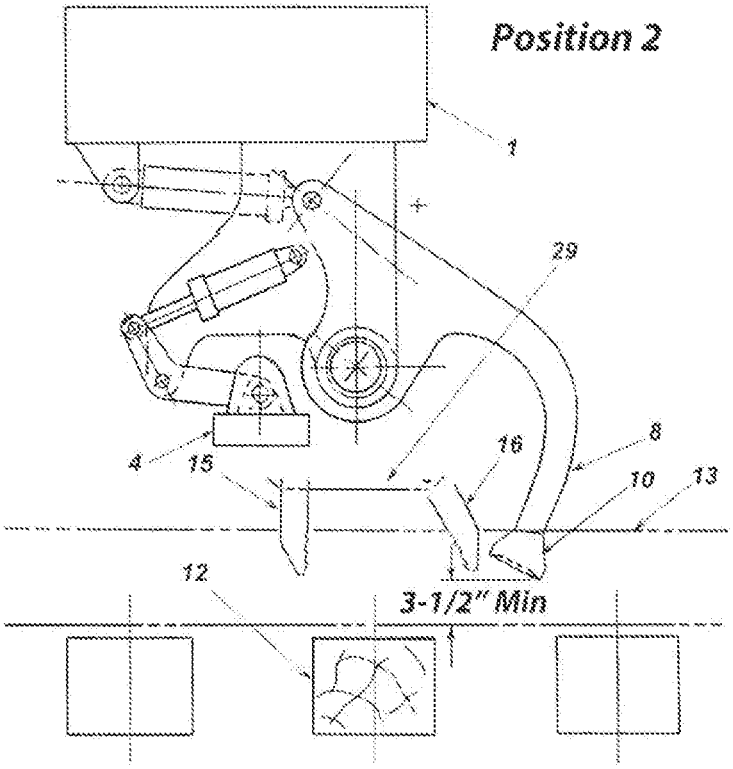
Figure 6:
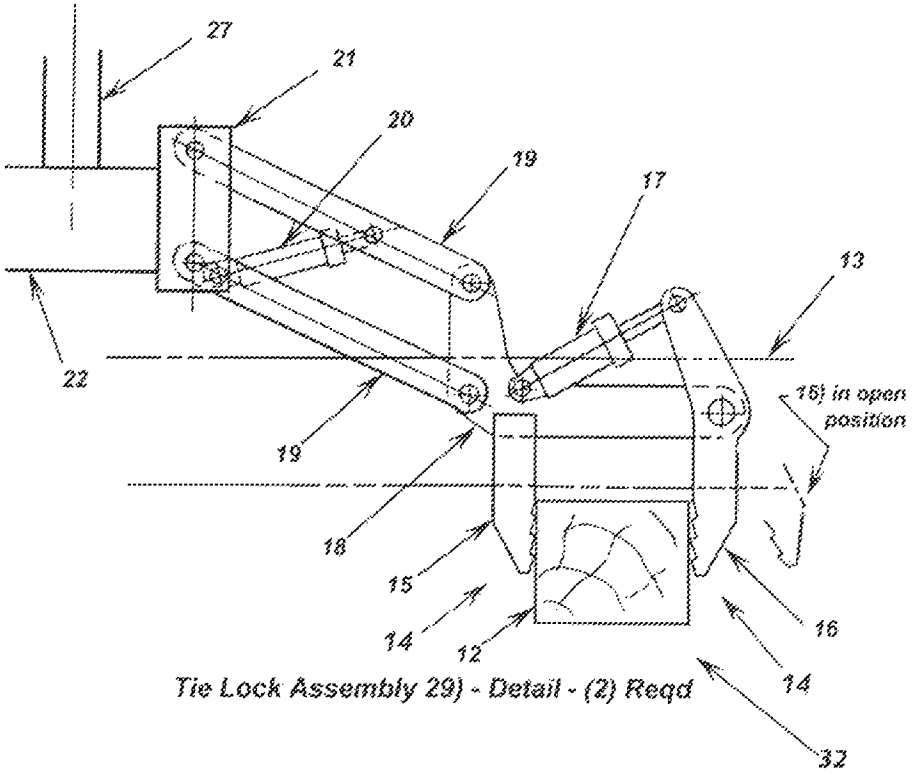

For convenience and speed during operation, there are three main positions of the track-engaging tool elements: Position 1—as shown in FIG. 4 with all tool elements safed-up and in the clear; Position 2—as shown in FIG. 5 with the tool elements poised at a lower position so only a small movement (<10") is required to engage the track elements in Position 3; and, Position 3—as shown in FIGS. 1 and 3 with all track-engaging tool elements in their respective working positions at the start of the replacement/compaction cycle.

Operating Sequence

The operator propels the BRC to the worksite and then places the tool elements into Position 2 as noted above. The BRC is then aligned with the first target tie to be tamped and the major tool elements are lowered, including the mass (1) and the tool elements attached (i.e., the compactor bars (8), the tie lock assemblies (29) and the crib compactors (4), as well as the associated sub-elements described above).

The tool elements are automatically sequenced with electro-hydraulic controls to reduce operator effort and speed up operations. The operator chooses at what rate to traverse the compactor bars (8) and the crib compactors (4) to reach good ballast consolidation as this will vary depending on the type ballast and how much it has been disturbed during old tie removal and new tie installation. When the compactor bars (8) have completed each cycle of compaction of the tie bed ballast, the crib compactors (4) are cycled on to compact the crib on the trailing side of the target tie (12).

When the compactor bars (8) and crib compactors (4) have completed the compaction of the tie bed and crib ballast, the track-engaging tools are raised to Position 2 (noted above) and the operator propels the BRC to the next target tie, at which time the compaction sequence is repeated.

This sequence is unique in placing new, clean ballast into the tie bed under the tie and also compacting the crib ballast. Both of these items are vital in getting newly-installed ties to have equal bearing of the wheels loads with the older ties already in track. Faster operation can be achieved by adding additional compactor bars (8) and crib compactors (4), with a larger horsepower engine and hydraulic system as required to match the power needs. The benefits of placing the clean ballast under the ties and consolidating the crib ballast would result in less track settlement and longer surface life.

Figure 7:
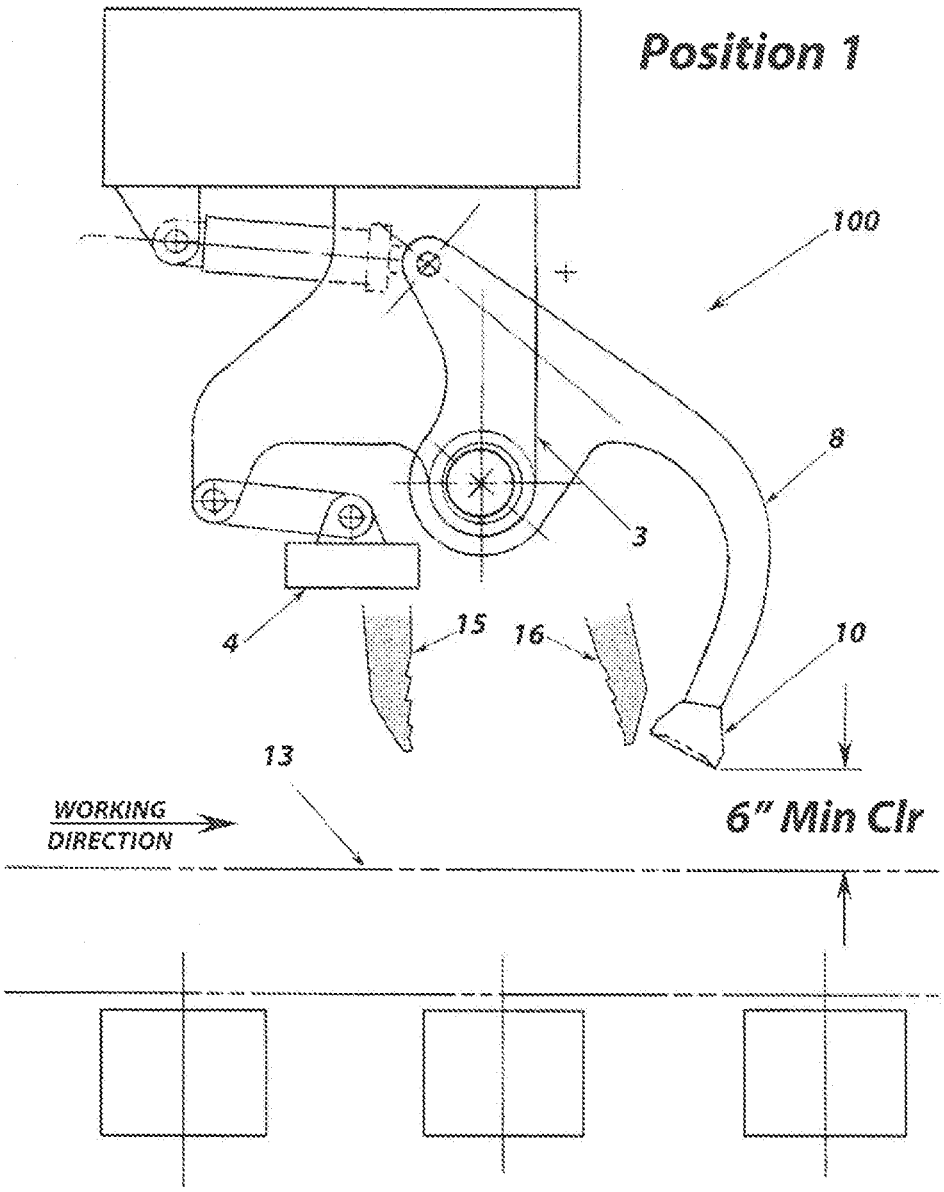
FIGS. 7-14 are schematic views of another example embodiment of a tie gang ballast replacer-compactor showing the system in operation in more detail (thus, depicting another embodiment of a method).
Figure 8:
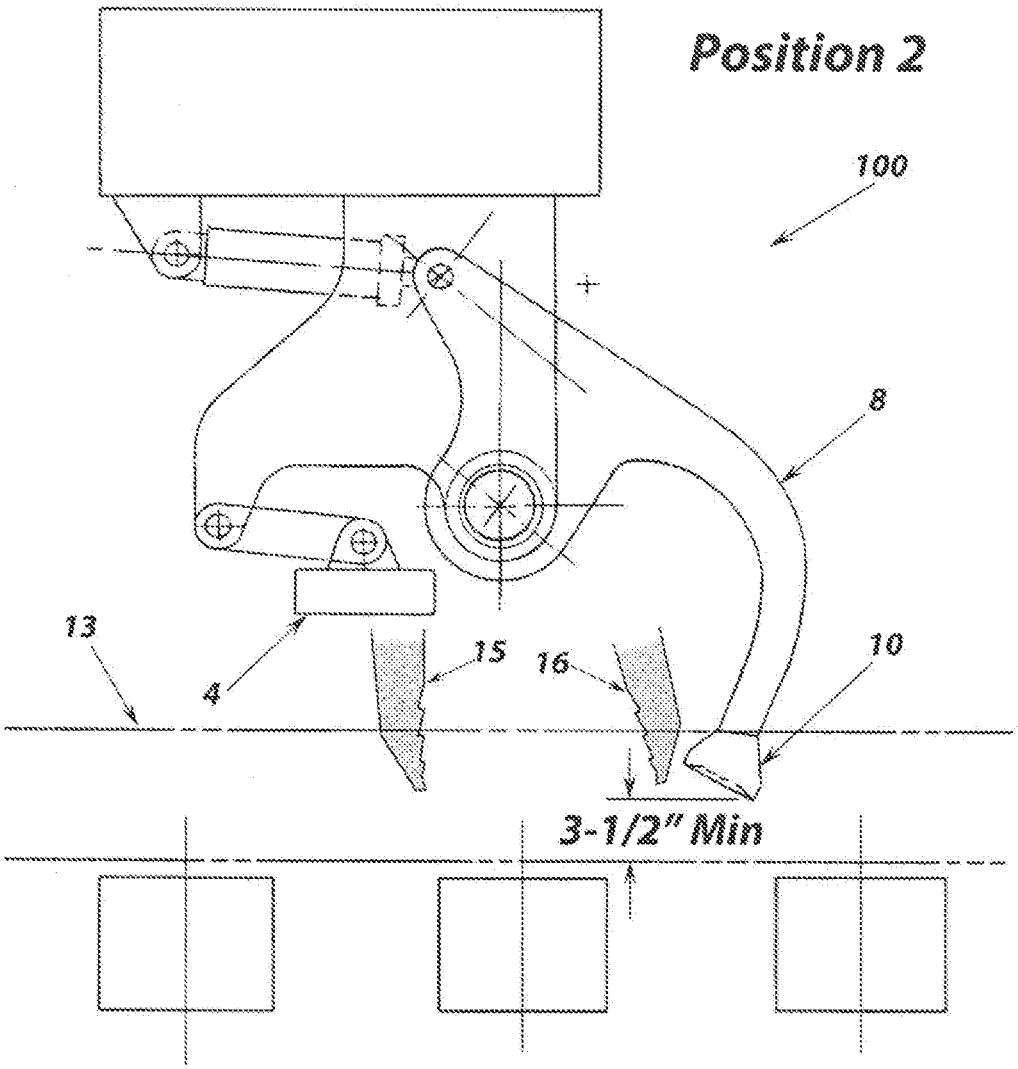
Figure 9:
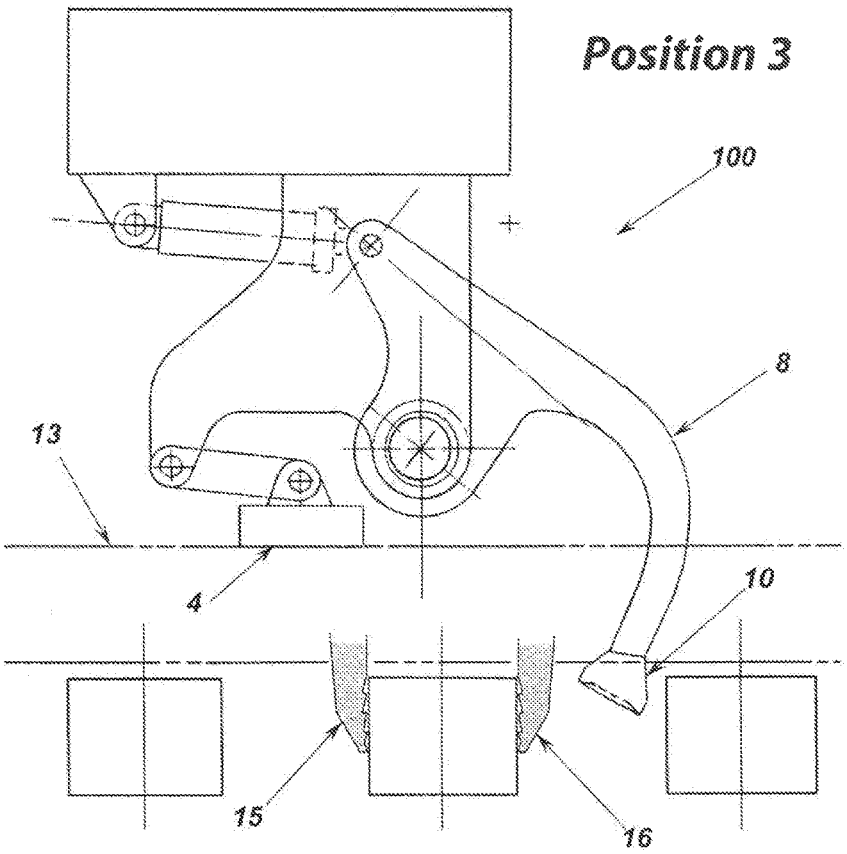
Figure 10:
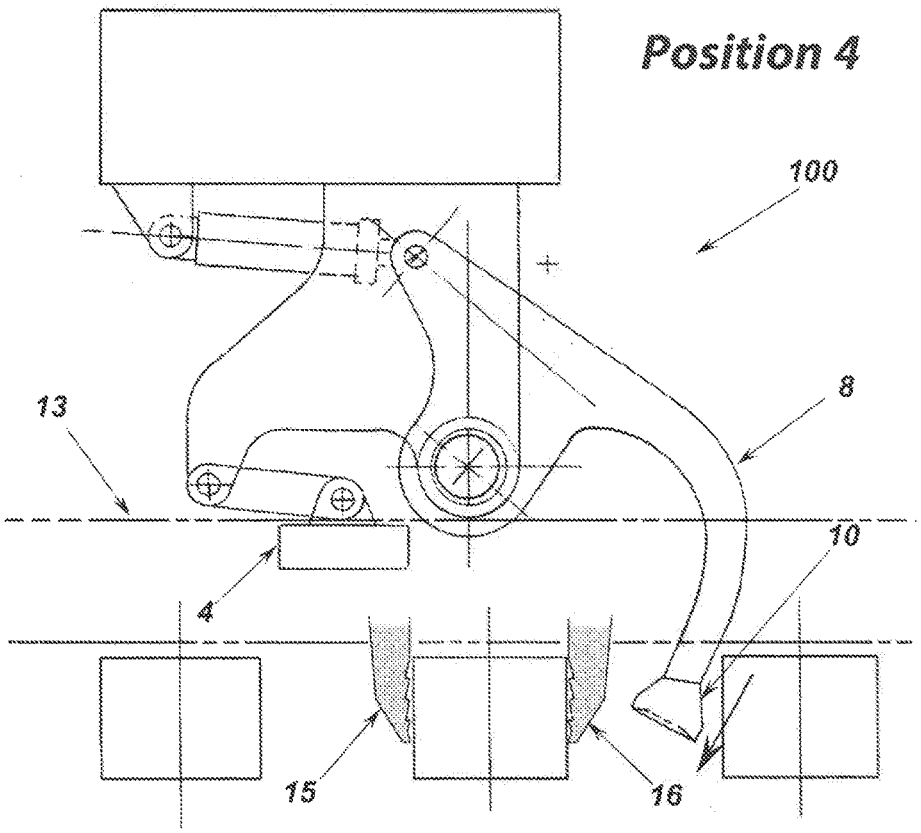
Figure 11:
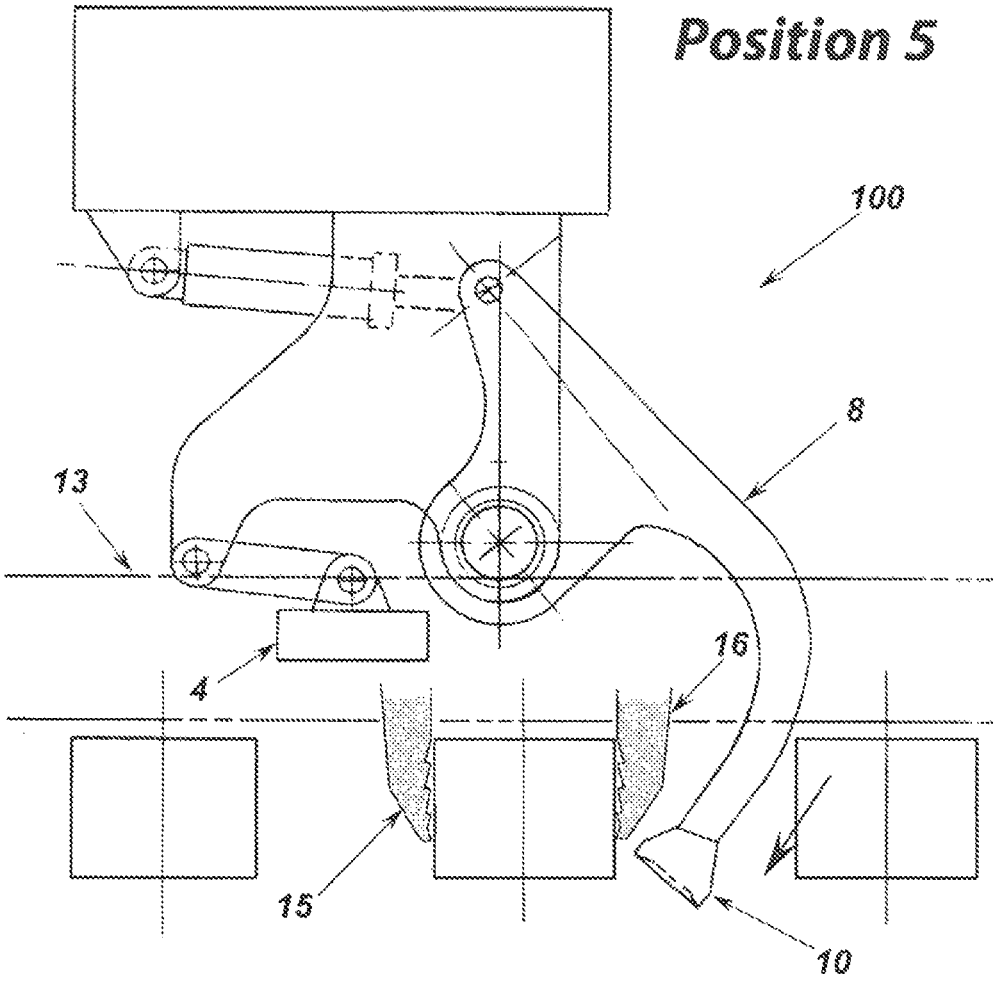
Figure 12:
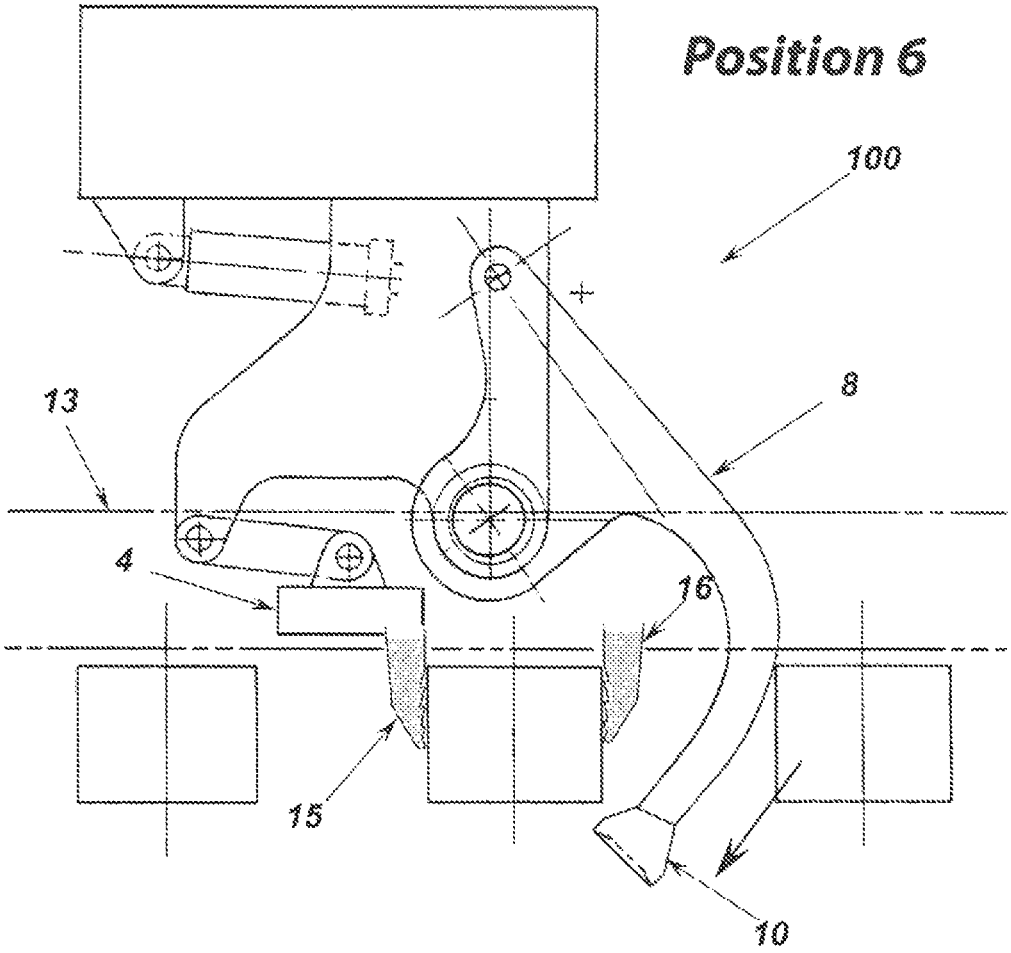
Figure 13:
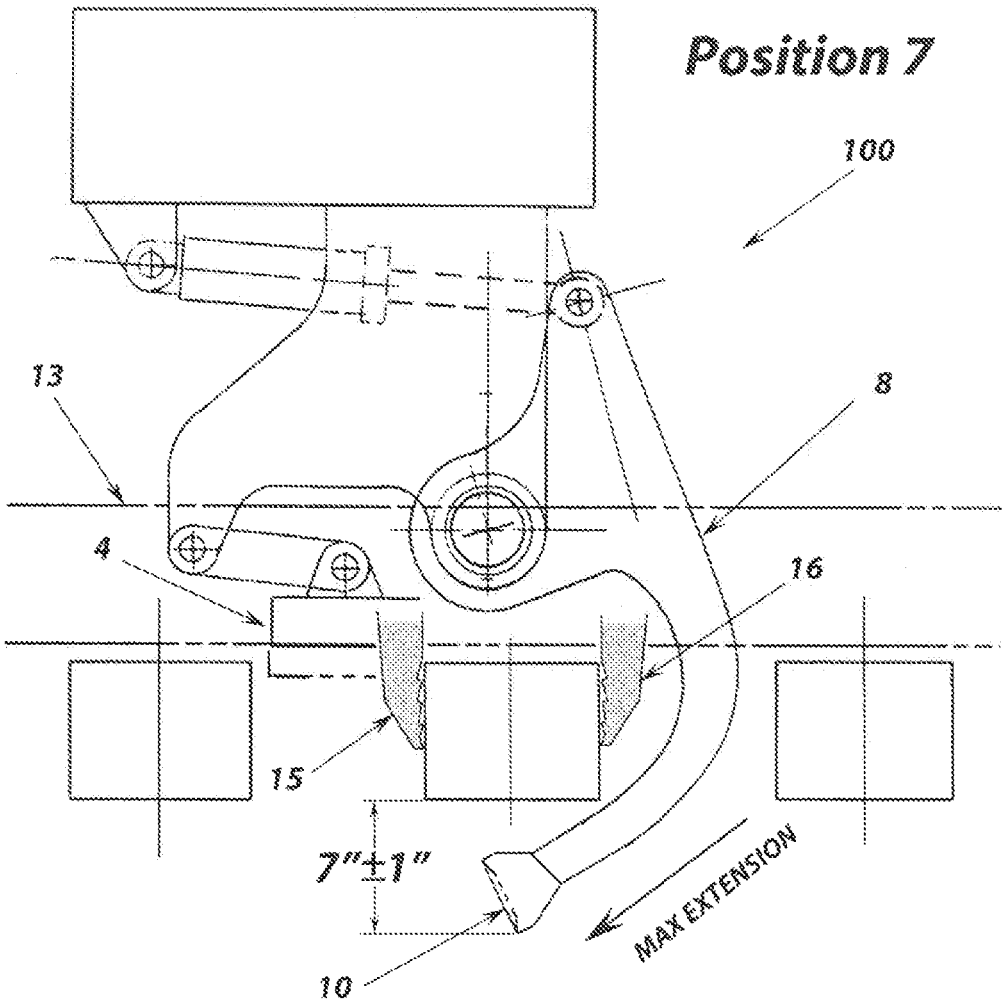
Figure 14:
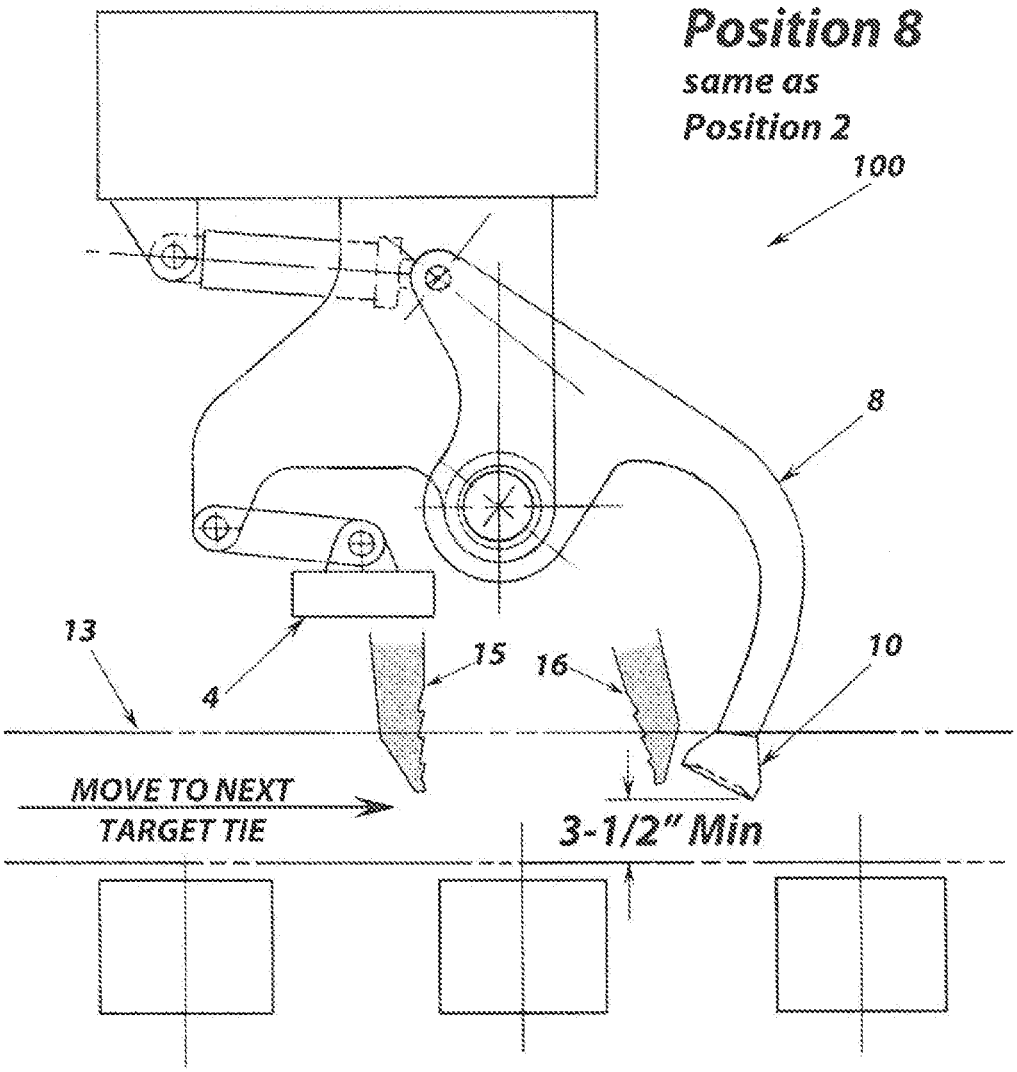

FIGS. 7-14 are schematic views of another example embodiment of a tie gang ballast replacer-compactor showing the system in operation in more detail (thus, depicting another embodiment of a method). As shown in FIG. 7, the work head is raised for clearing travel at track speed. In FIG. 8, the work head is raised to clear ties and track for movement between ties during the work cycle, which facilitates travel at low speed. In FIG. 9, the work head is positioned for the start of the replace/compact cycle. In particular, the tie locks are engaged about a tie and the compaction cycle is ready to begin. In FIG. 10, the compactor bar begins its stroke, moving into a crib and pushing clean stone with it. As shown in FIG. 11, the compactor bar continues the stroke, moving in an arc downwardly and rearwardly pushing the clean stone with it. In FIG. 12, the compactor bar continues the stroke, moving under the front edge of the clamped tie, pushing clean stone with it. In FIG. 13, the compactor bar continues the stroke to maximum extension under the tie and the ballast is compacted. In FIG. 14, after the compaction cycle is complete, the BRC's track engaging tools are then retracted to "Position 2/8", ready to move to the next target crosstie to be tamped. It should be noted that, in some embodiments, variable frequency vibration is applied to the ballast through the pusher faces obtain the enhanced compaction of the ballast.

Component List of an Example Embodiment

1) Mass Weight—attaches to numerous items
2) Hydraulic Cylinder to operate Compactor Bar
3) Steel welded frame attached to Mass 1) that supports Compactor Bars 8) & Crib Compactor 4) & 5)
4) Crib Compactor (4) ea
5) Vibrator Motor for Crib Compactor 4)
6) Lift Linkage for Crib Compactor 4)
7) Lift Hydraulic Cylinder for Crib Compactor 4)
8) Compactor Bar Assy
9) Vibratory Eccentric Drive mechanism (4) ea that pivotally support Compactor Bars 8)
10) Ballast Pusher Faces (4) ea, replaceable
11) Parabolic path the Ballast Pusher Face 10) describes as it cycles down through the crib ballast, pushing & compacting it under the crosstie 12)
12) Crosstie (wood, concrete, plastic, steel); part of railroad track
13) Railroad Rail, any weight & size, part of railroad track
14) Crib Ballast between ties, part of railroad track
15) Tie Lock Jaw, fixed, (2) ea
16) Tie Lock Jaw, moveable, (2) ea
17) Hyd. Cylinder to operate Tie Lock Jaw 16) (2) ea
18) Welded steel frame that mounts Tie Lock components 15), 16) & 17); (2) ea
19) Linkage Arms that movably support Tie Lock components 15), 16), 17) & 18); (4) ea
20) Hyd. Cylinder that raises/lowers Tie Lock Assy 29); (2) ea
21) Bracket on Chassis 22) where Tie Lock Assy 29) is pivotally mounted; (2) ea
22) Chassis, self-propelled, fabricated steel with (2) axles, (4) flanged wheel, an engine, hydraulic, pneumatic & electrical systems and an operators control station
23) Laterally Movable Brackets attached to Mass 1); (8) ea
24) Hyd. Cylinder to move Mass 1) & its attachments laterally; (2) ea
25) Horizontal Support Bars that support Mass 1) & permit lateral movement; (2) ea
26) Vertically Movable Support Frame that support Horiz. Support Bars 25) & Mass 1); (2) ea
27) Vertical Slide Posts that support Vertically Movable Support Frame 26) and all dependent attachments; (2) ea
28) Hyd. Cylinder to move the Vertically Movable Support Frame 27) and all dependent attachments; (2) ea
29) Tie Lock Assembly, complete, includes 15) through 20) items inclusive; (2) ea
30) Flanged Wheels, attached to Chassis 22), (4) ea or more depending on size/weight of Chassis
31) The general area of Crib Ballast 14) that can be reached & tamped by the Ballast Pusher Faces as they are moved laterally throughout the total range of lateral movement & cycled down & up
32) The total ballast section under the ties of the railroad track; often badly fouled
33) Phantom outline of Mass 1), Compactor Bars 8), Ballast Pusher Faces 10), and Crib Compactors 4) & 5) in the "innermost" position of lateral movement so as to cover the maximum length of tie bed ballast section It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

The invention claimed is:

1. A ballast replacer/compactor for servicing rail ties supported by crib ballast, the ties being positioned along an extending direction of the rails, the ballast replacer/compactor comprising:

a frame;

a tie lock assembly mounted to the frame and having a set of downwardly-extending jaws, the jaws being movable between an open position and a closed position, in the closed position the jaws being configured to clamp opposing front and rear sides of a target tie of the ties, relative to the extending direction of the rails, to inhibit movement of the target tie from a crib ballast-supported position of the target tie;

a crib compactor mounted to the frame and operative to compact crib ballast located behind the target tie while the jaws of the tie lock assembly are in the closed position about the target tie; and a compactor bar, mounted to the frame, having a pusher face on a distal end thereof, the pusher face being movable through a downwardly and rearwardly directed arc during a ballast pushing motion to urge crib ballast, located adjacent the front side of the target tie, downwardly and rearwardly beneath the target tie as the pusher face is moved through the arc from a first positon forward and above the target tie to a second position beneath the target tie while the jaws of the tie lock assembly are in the closed position about the target tie;

wherein the frame is operative to position the tie lock assembly, the crib compactor and the compactor bar adjacent to the target tie.

2. The ballast replacer/compactor of claim 1, wherein the crib compactor has a plate and a motor, the motor being operative to vibrate the plate.

3. The ballast replacer/compactor of claim 1, further comprising a motorized chassis to which the frame is attached.

4. The ballast replacer/compactor of claim 1, wherein the replacer/compactor is operative to vibrate the pusher face for moving the ballast.

5. A method for servicing rail ties supported by crib ballast, the ties being positioned along an extending direction of the rails, the method comprising:

clamping opposing front and rear sides of a target tie with a set of downwardly-extending jaws of a tie lock assembly to inhibit movement of the target tie from a crib ballast-supported position of the target tie;

moving a pusher face of a compactor bar through an arc from a first positon, forward and above the target tie, to a second position, beneath the target tie, to force crib ballast, located adjacent the front side of the target tie, downwardly and beneath the target tie while the jaws of the tie lock assembly are in the closed position about the target tie; and compacting crib ballast located behind the target tie while the jaws of the tie lock assembly are in the closed position about the target tie.

6. The method of claim 5, wherein at least some of the crib ballast forced downwardly and beneath the target tie is clean crib ballast.

7. The method of claim 5, wherein compacting comprises vibrating the crib ballast with a vibrating component contacting the crib ballast at a location rearward of the target tie.

8. The method of claim 5, further comprising using a reaction mass to prevent the rails from humping during the compacting.

* * * * *